US006233781B1

(12) United States Patent
Savage

(10) Patent No.: US 6,233,781 B1
(45) Date of Patent: May 22, 2001

(54) REFUSE CONTAINER

(75) Inventor: Alan Clyde Hayes Savage, West Vancouver (CA)

(73) Assignee: Southern Gold Resources Ltd., West Vancouver (CA)

( * ) Notice: Subject to any disclaimer, the term of this patent is extended or adjusted under 35 U.S.C. 154(b) by 0 days.

(21) Appl. No.: 09/458,088

(22) Filed: Dec. 10, 1999

(51) Int. Cl.[7] ..... A47L 13/52
(52) U.S. Cl. ..... 15/257.4; 15/257.7
(58) Field of Search ..... 15/257.1, 257.4, 15/257.7, 257.8, 257.9; 220/763; D32/74

(56) References Cited

U.S. PATENT DOCUMENTS

Re. 13,296 * 10/1911 Lewis .
587,607 * 8/1897 Ray ..... 15/257.7
881,758 * 3/1908 Wynkoop ..... 15/257.7
2,699,050 * 1/1955 MacKay ..... 15/257.7
2,978,731 * 4/1961 Belluomini ..... 15/257.4
5,325,565 * 7/1994 Suzuki ..... 15/257.9
5,457,844 * 10/1995 Hanna et al. ..... 15/257.9

* cited by examiner

*Primary Examiner*—Terrence R. Till
(74) *Attorney, Agent, or Firm*—Shlesinger Arkwright & Garvey, LLP

(57) ABSTRACT

A refuse container includes a housing having an opening for receiving refuse, a bail pivotally attached to the housing for pivotal movement between a first position in front of the opening and a second position adjacent the housing, a handle attached to the housing positioned adjacent to the bail when the bail is in the second position and an attachment member for releasably attaching the bail to the attachment member when the bail is in the second position, the attachment member positioned adjacent the handle.

18 Claims, 9 Drawing Sheets

REFUSE CONTAINER

FIELD OF THE INVENTION

This invention relates to a refuse accumulator and container and more particularly relates to a refuse accumulator and container which permits control of the bail of the container when the contents of the container are dumped.

BACKGROUND OF THE INVENTION

Containers for accumulating refuse or other materials commonly include a bail, or handle member pivotally connected to the sides of the container at diametrically opposed points enabling lifting and transporting of the container by gripping the bail. The bail is used to hold the container in an upright position with the container opening at the top to prevent discharge of the contents of the container. The bail is manually held to one side and away from the opening by the user when the container is tipped from its upright position to discharge the container contents.

These types of containers can also include a handle on the container itself to assist the user in pivoting the container to eject the contents thereof. Such a container is depicted in U.S. Pat. No. 123,569 to Lothrop. Lothrop discloses a container having bail c pivotally connected to container A at diametrically opposed points A. Handle B is fastened to the sides of container A. Handle B also serves as a rest to prevent bail c from contacting the side of the container in order to insulate the bail from the hot surface of the container.

U.S. Pat. No. 1,205,064 to Varian depicts container 10 with bail 18 and handle 19. The patent describes the use of this type of container at column 2, lines 95–102:

> "When it is desired to empty the receptacle, the same is carried by the bail 18 until the regular garbage receptacle is reached, whereupon the handle 19 is grasped, so as to swing the receptacle to a horizontal position, by reason of its pivotal connection with the bail 18, the front wall 11, resting upon the mouth of the larger receptacle."

However none of the prior art containers comprising a bail and handle member for use in the manner described provide a simple means for retaining the bail adjacent the container when the container is rotated to dump the contents. Often the force of gravity on the bail will cause the bail to rotate into a position in front of the opening thereby partially blocking the refuse exiting through the opening from the container. This interferes with efficient dumping of the contents of the container and as well can result in dirt and other foreign materials adhering to the bail which can then be transferred to the hands of the user when the bail is used to carry the container.

As a result there is a need for a container having a bail pivotally connected to the container and a handle at the side of the container with an attachment member adjacent the handle which permits releasable attachment of the bail to the attachment member when the bail is adjacent the side of the container. This feature would prevent the bail from rotating to a position in front of the opening thereby preventing the bail from interfering with the dumping of refuse in the container and preventing the bail from being dirtied by the contents of that container.

BRIEF SUMMARY OF THE INVENTION

A refuse container according to the invention includes a housing having an opening for receiving refuse, a bail pivotally attached to the housing for pivotal movement between a first position in front of the opening and a second position adjacent the housing, a handle attached to the housing positioned adjacent to the bail when the bail is in the second position and an attachment member for releasably attaching the bail to the attachment member when the bail is in the second position. The attachment member is positioned on the housing adjacent the handle to permit attachment of the bail to the attachment member when the bail is in the second position.

In another aspect of the invention, the attachment member can include a clip dimensioned to securely and releasably hold the bail within the clip. The clip may be a finger element which is dimensioned with respect to the housing to retain the bail between the element and the housing by means of friction between the element, the housing and the bail. The clip may alternatively comprise a finger element dimensioned and shaped with respect to the housing to retain the bail between the element and the housing by means of a snap fit of the bail with respect to the element and housing.

In another aspect of the invention the container may further include a bail rest adjacent to the attachment member positioned to contact the bail when the bail is near the second position without the bail being releasably secured by the attachment member. The bail rest may be positioned with respect to the handle to enable the thumb of a user to restrain the bail against the rest while simultaneously gripping the handle.

DESCRIPTION OF THE PREFERRED EMBODIMENT

Figure 1:
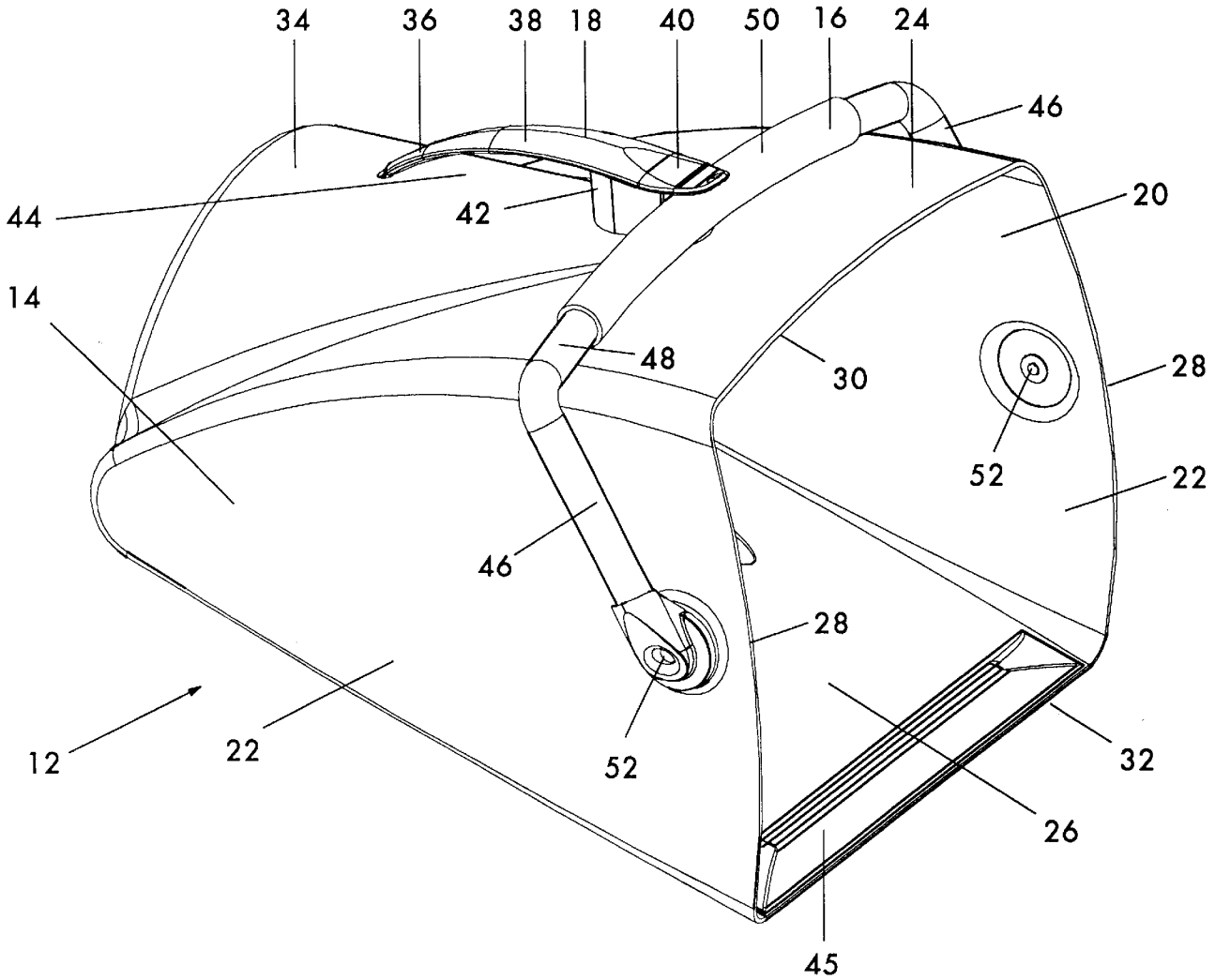
FIG. 1 is a perspective front view of the refuse container of the present invention.

Referring to FIG. 1, container 12 includes housing 14, bail 16 and handle 18.

Housing is preferably integrally molded as a unitary article and includes opening 20 formed in housing 14.

Housing 14 includes a pair of opposed parallel side members 22 connected to top member 24 and bottom member 26 of housing 14. Side members 22 include front edges 28. Top housing 14. Side members 22 include front edges 28. Top member 24 includes front edge 30 and bottom member 26 includes front edge 32. Edges 28, 30 and 32 define rectangular opening 20 at the front of container 12.

Housing 14 includes upper semi-circular portion 34 connected to top member 24 which slopes downwardly towards bottom member 26 toward the rear of container 12 to merge with portion 34.

Figure 3:
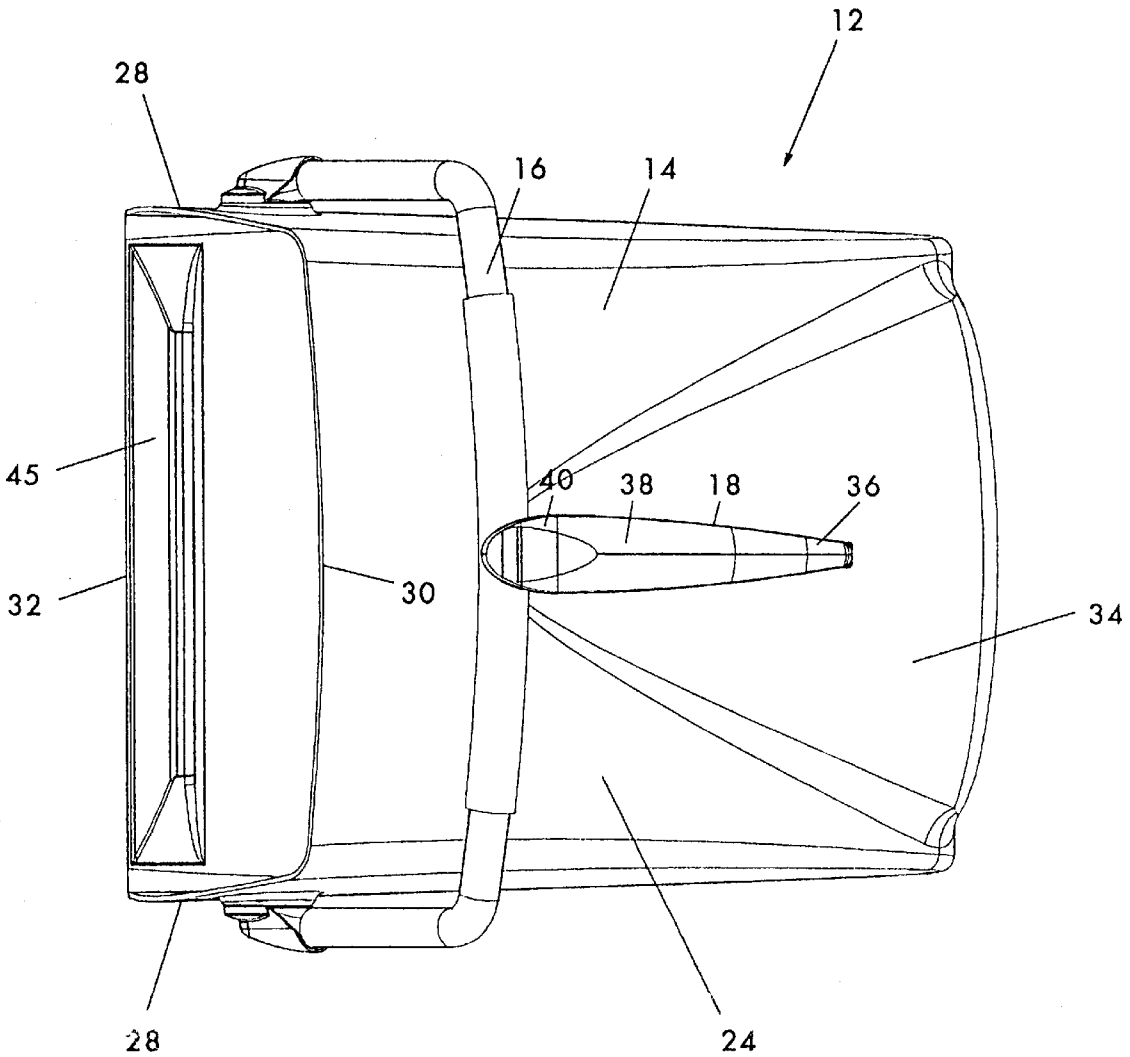
FIG. 3 is a top view of the container of FIG. 1.
Figure 8:
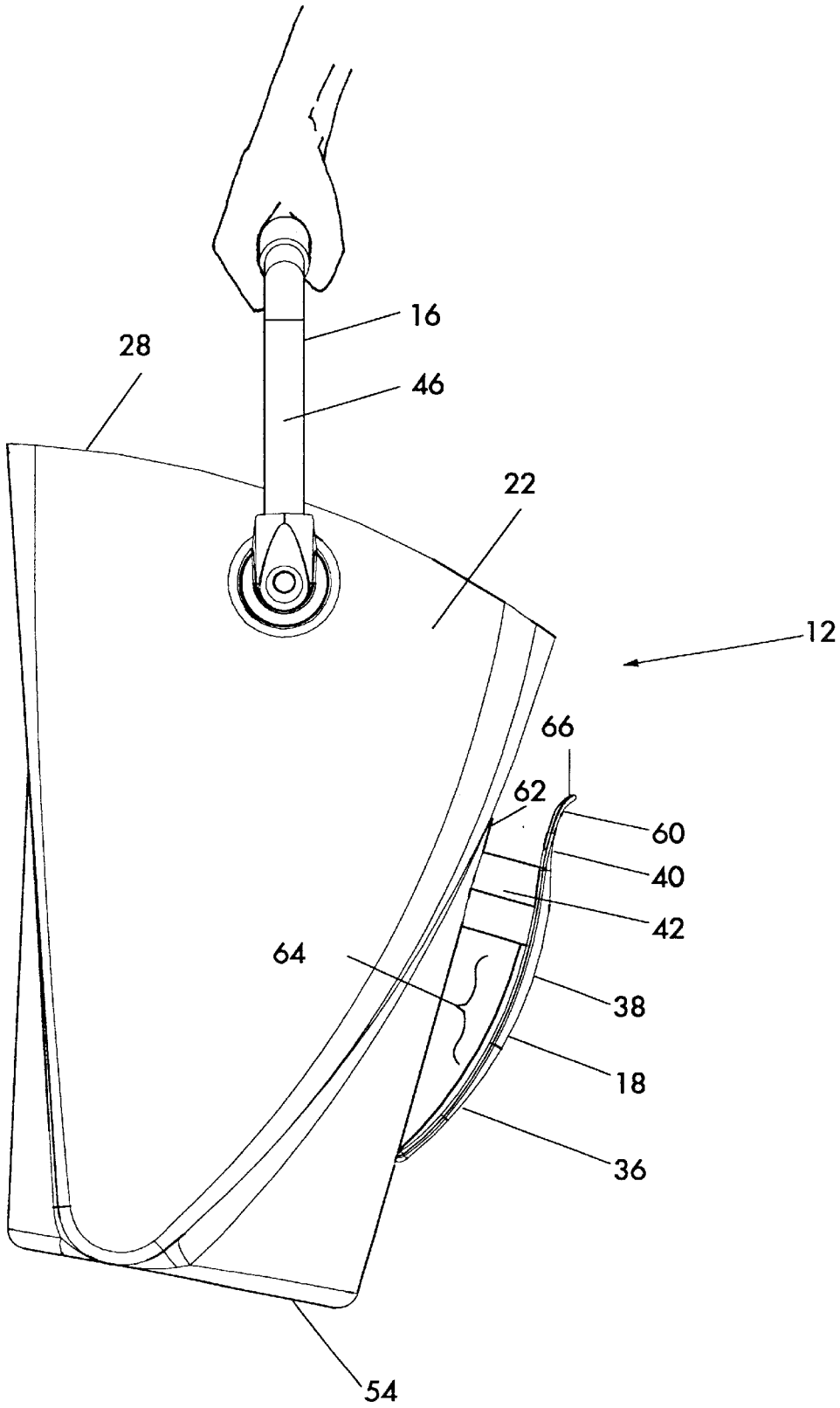
FIG. 8 is a side view of the refuse container of FIG. 1 showing the lifting and transporting of the container in an upright position using the bail.

As seen best in FIGS. 3 and 8, edges 28 are curved rearwardly moving towards upper side 24. This results in bottom member 26 extending further forward as compared to top member 24 facilitating use of a broom, rake or other implement to direct refuse into container 12.

Figure 6:
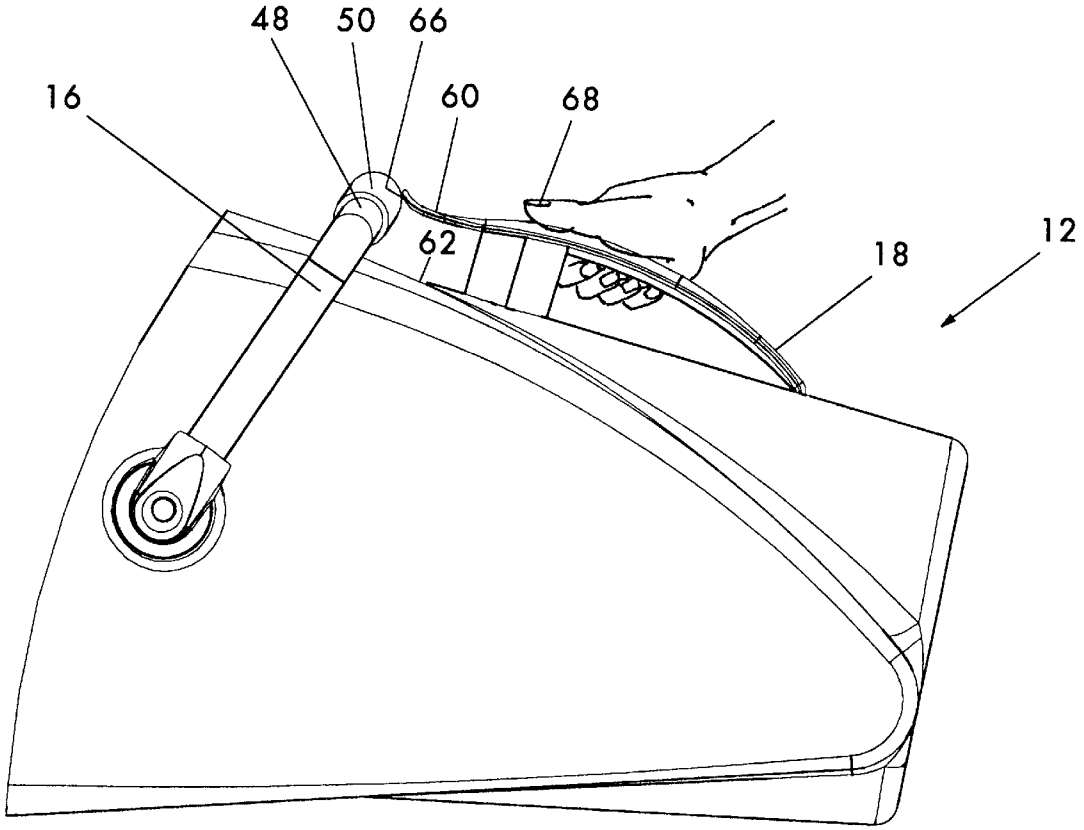
FIG. 6 is a side view of the refuse container of FIG. 1 showing the hand of a user gripping the handle and the bail in a position adjacent to but not contacting the bail rest.
Figure 7:
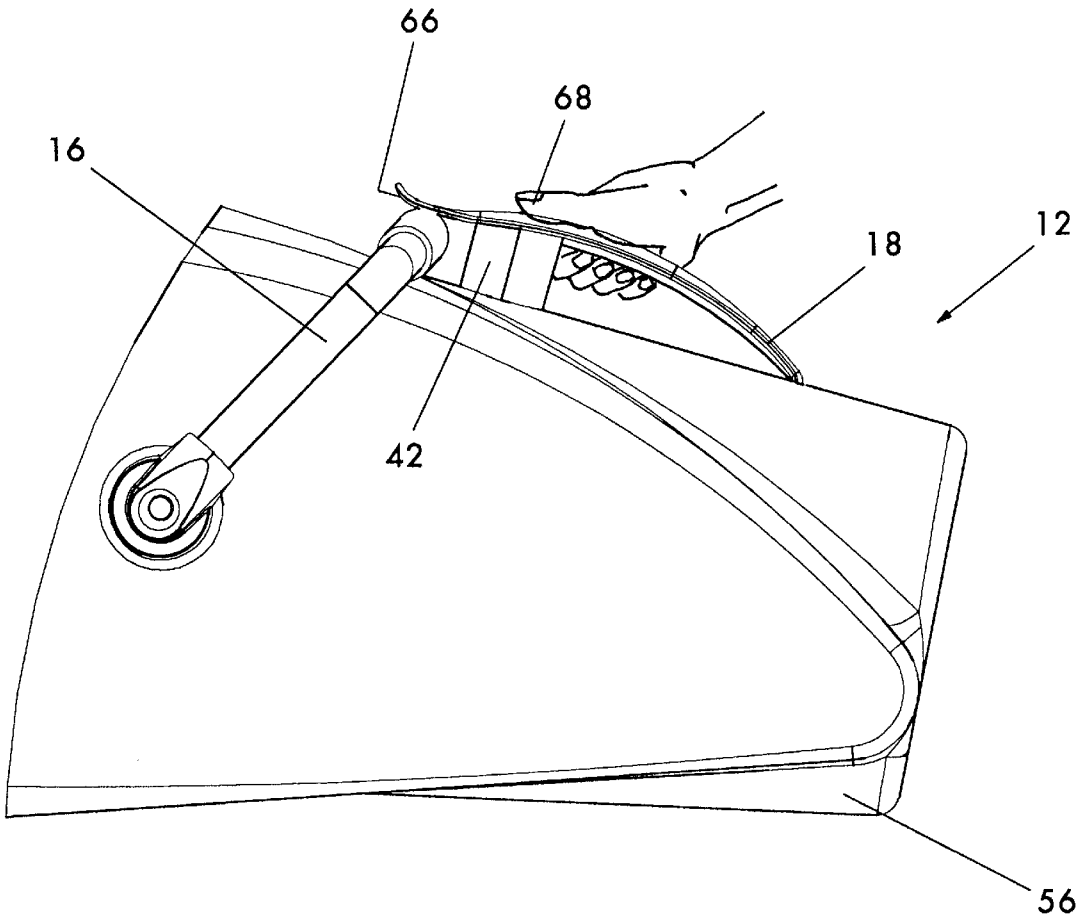
FIG. 7 is a side view of the refuse container of FIG. 1 showing the thumb of the user contacting the bail and retaining the bail against the bail rest.

Referring to FIGS. 1 and 3, handle 18 extends longitudinally along an axis parallel with the central axis of housing 14 and perpendicular to bail 16. Handle 18 includes downwardly sloping rear section 36 connected to circular portion 34 at the rearmost part of handle 18, intermediate section 38 used to grip handle 18 and forward section 40. Handle 18 also includes support 42 which supports intermediate and forward sections 38 and 40 and provides a spaced opening 44 to permit a user to grip handle 18 (as depicted in FIGS. 6 and 7).

As depicted in FIGS. 1 and 3, bottom member 26 includes downwardly sloping section 45 which slopes downwardly to merge with bottom edge 32. Section 45 facilitates sweeping or raking of debris into opening 20 and container 12.

Figure 2:
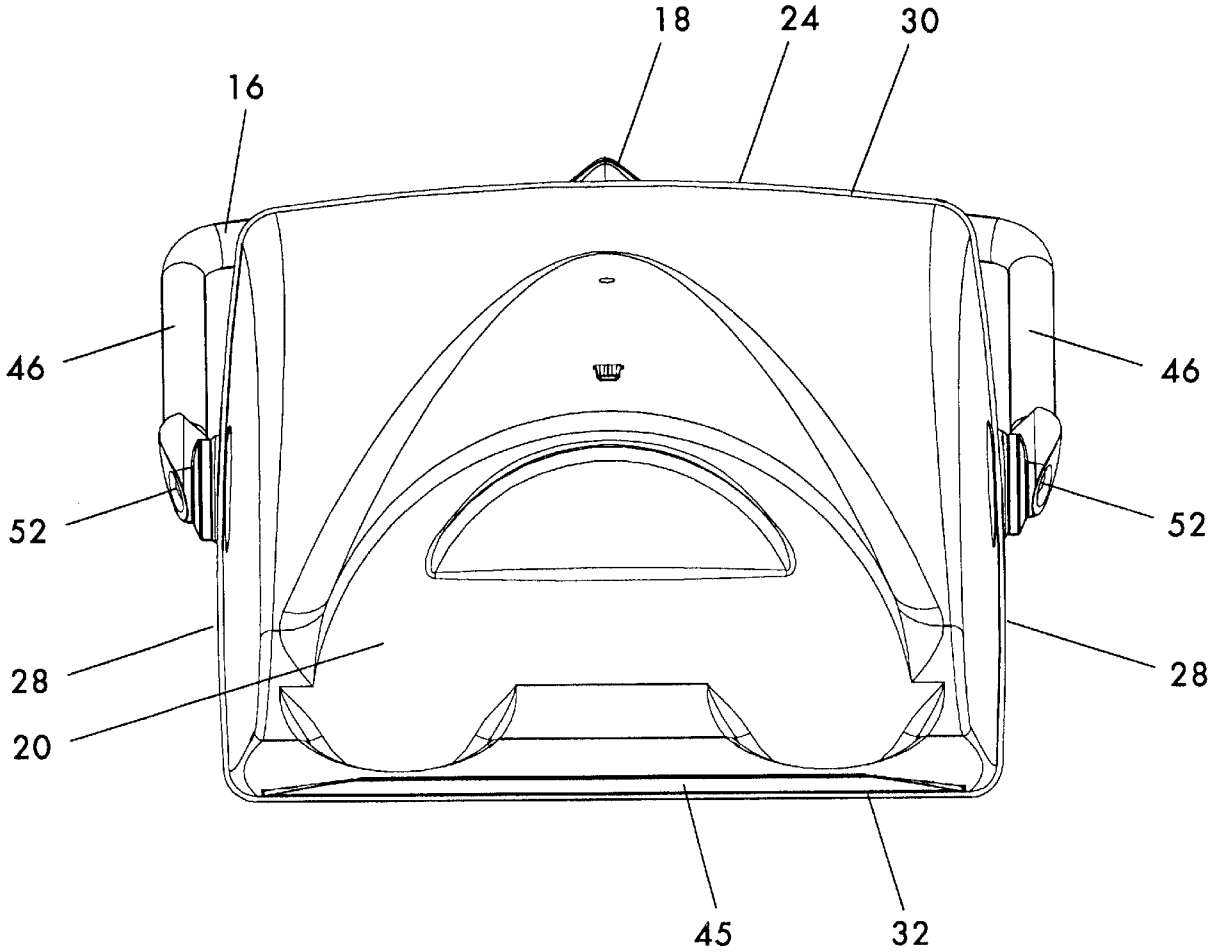
FIG. 2 is a front plan view of the container of FIG. 1.
Figure 5:
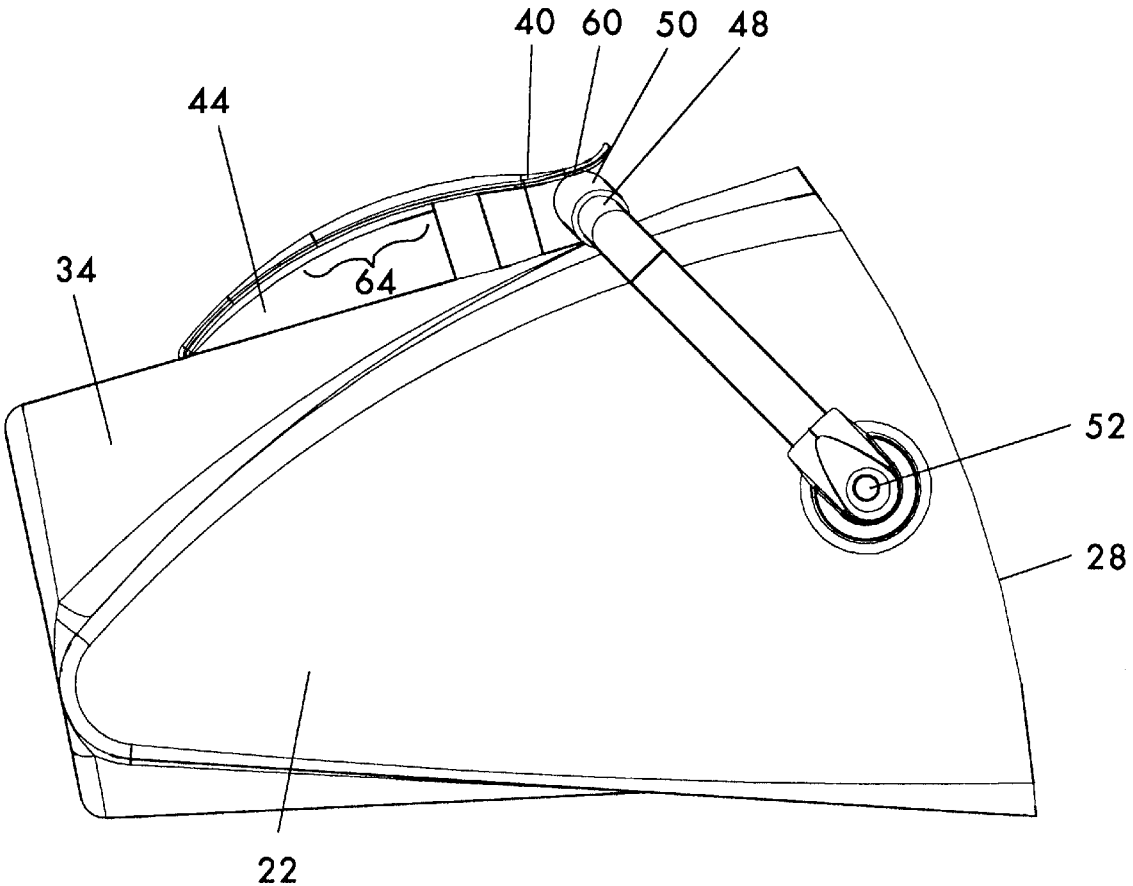
FIG. 5 is a side view of the refuse container of FIG. 1 showing the bail releasably secured in the attachment member.

Bail 16 includes a pair of opposed lateral extension members 46 seen best in FIGS. 1 and 2. Extension members 46 merge with, and are joined by, cross member 48. Cross member 48 includes resiliently deformable pad 50 to facilitate gripping of bail 16 by a user and to facilitate releasable attachment of bail 16 as described below. Extension members 46 are hingedly attached on respective opposed side members 22 of housing 14 at hinges 52. Hinges 52 permit bail 16 to be pivoted or rotated between a first position in front of opening 20, as depicted in FIG. 8, and a second position adjacent top member 24 as depicted in FIGS. 1 and 5. It should be understood that bail 16 may be pivotable or rotatable past the first position all the way to position with cross member 48 adjacent bottom member 26.

Figure 9:
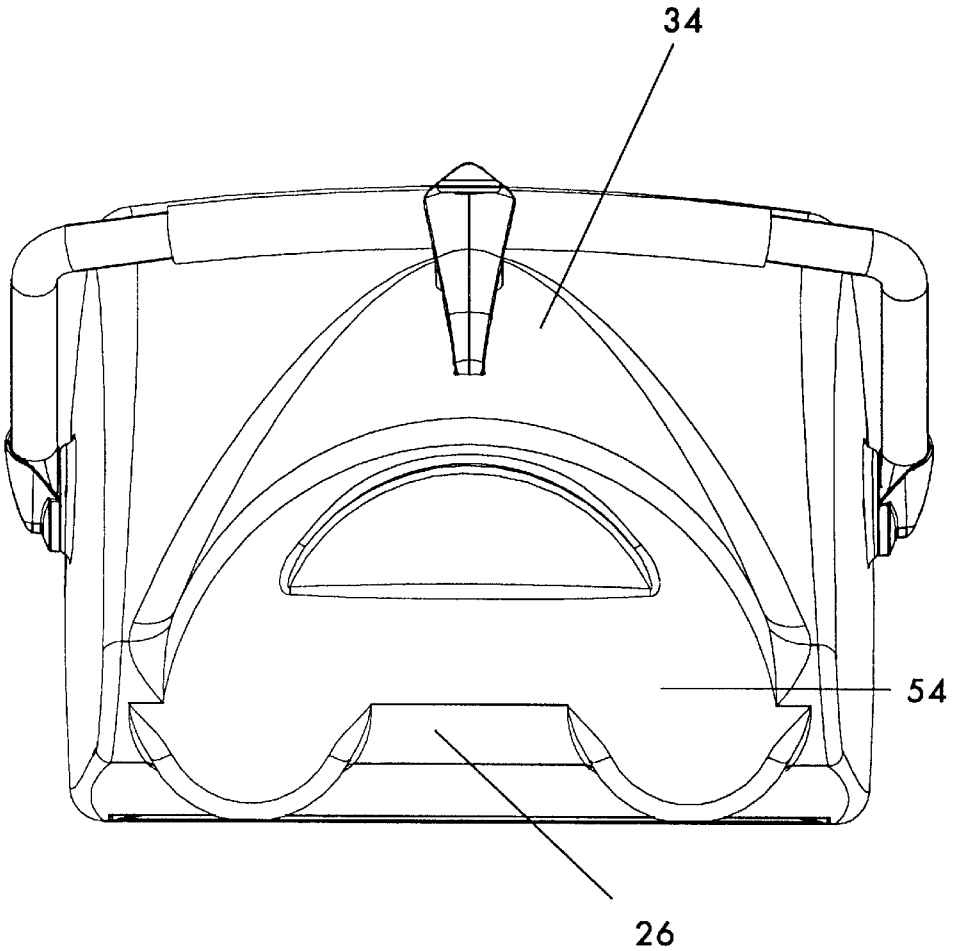
FIG. 9 is a rear view of the container of FIG. 1.

Referring to FIG. 9, upright support section 54 is formed integrally with semi-circular portion 34 and bottom member 26. Support section 54 permits the resting of container 12 in its upright position, as depicted in FIG. 8, with support section 54 resting on a support surface such as the ground or a floor.

Figure 4:
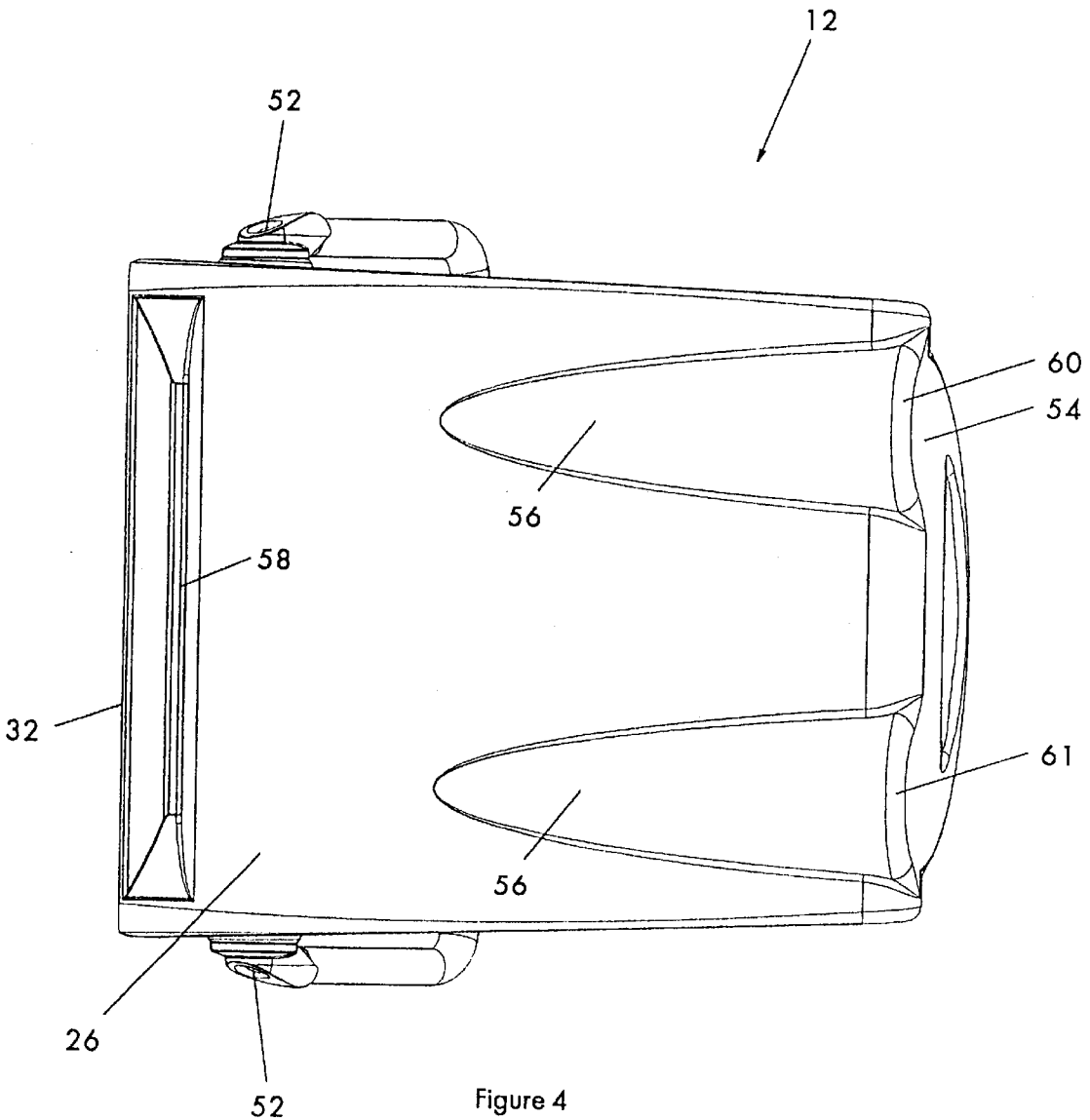
FIG. 4 is a bottom view of the container of FIG. 1.

Referring to FIG. 4, bottom member 26 includes a pair of generally bullet-shaped extensions 56 in parallel alignment positioned at a rear part of member 26. Indent 58 conforms to downwardly sloping section 45 of bottom member 26. Rear portions 61 of extensions 56 merge with support section 54 at the rear of extensions 56. Extensions 56 serve to support container 12 when the container is in its side position as depicted, for example, in FIG. 1.

Referring to FIGS. 1 and 6, forward section 40 includes resiliently deformable extension 60 in spaced parallel relation with housing contact area 62. Extension 60 is spaced from area 62 sufficient to enable cross member 48, with pad 50 to fit snugly in the space between extension 60 and area 62, as depicted in FIG. 5. Extension 60 is further spaced from area 62 in such as a manner to permit release of cross member 48 and pad 50 from between extension 60 and area 62 upon application of sufficient force to pull cross member 48 from between extension 60 and area 62.

As seen in FIG. 6, and in another option of this invention, extension 60 includes bail rest 66 aligned with bail 16 when bail 16 is approaching or near its second position. Bail rest 66 does not securely retain bail 16 against housing contact area 62. Instead bail rest 66 provides a convenient non-secured stop position to permit thumb 68 of a user to retain bail 16 against rest temporarily without releasably securing rest 66 between extension 60 and area 62.

As well bail rest 66 provides a convenient guide to assist thumb 68 of a user to move the bail 16 into its second position releasably secured between extension 60 and area 62.

As an alternative to the friction fit of cross member 48 and pad 50 between extension 60 and area 62, extension 60 may be contoured in such a manner that cross member 48 and pad 50 pass through a restricted area into a larger housing area to provide a releasable snap-fit of cross member 48 and pad 50 in the space between extension 60 and area 62.

As seen in FIG. 5, the other optional feature of the bail rest 66 in conjunction with the relative position of handle gripping portion 64 with respect to the position of bail 16 when contacting bail rest 66, provides the advantage of enabling the user's thumb 68 to grip bail 16 and retain it against rest 66 while the fingers of the user simultaneously grip handle gripping portion 64. This permits the user to dump the contents of container 12 by tilting container 12 using handle 18 to position opening 20 below housing 14, while simultaneously restraining bail 16 against rest 66 with the user's thumb 68, as depicted in FIG. 7. This prevents bail 16 from rotating from its second position to a position in front of opening 20 on tilting of container 12 to dump its contents.

OPERATION

The operation of container 12 will now be discussed with reference to FIGS. 1, 6, 7 and 8. Container 12 is placed on the ground on its bottom member 26, supported on a support surface, such as the ground or a floor, by extensions 56 such that edge 32 contacts that support surface. Bail 16 may either be placed near its second position resting against rest 66 (as depicted in FIG. 6) or releasably engaged by extension 60 holding cross member 48 and pad 50 in a friction fit or snap fit engagement with respect to housing contact area 62 (as depicted in FIG. 5). The user can then sweep or rake refuse such as dirt and other foreign materials from the floor, or rake leaves or other lawn or garden debris into housing 14 through opening 20. Because edge 30 is set back towards the rear of housing 14, in relation to edge 32 sweeping or raking debris into housing 14 is facilitated by enabling the rake, broom or other implement to travel partially into housing 14 through opening 20. When housing 14 is full, or otherwise as desired by the user, the container can be lifted and moved by releasing or moving bail 16 from engagement with extension 60 or from rest 66 and lifting bail 16 upwardly. This results in the rotation of container 12 about hinges 52 with respect to bail 16 as the front of container 12 is lifted from the support surface. On further lifting, container 12 is rotated to its upright position, generally as depicted in FIG. 8. The contents of container 12 are retained in housing 14 with opening 20 at the top. Container 12 may then be set down in its upright position on the support surface, on upright support section 54. The container 12 may be carried by the user gripping bail 16, as depicted in FIG. 8.

When it is desired to dump the contents of container 12, the user tilts container 12 by gripping handle 18 and bail 16. The user rotates bail 16 towards the second position to move bail 16 away from opening 20 to prevent bail 16 from interfering with the discharge of contents from container 12. Bail 16 is rotated to its second position where it is releasably attached between extension 60 and contact area 62 as described above. The user then continues to tilt container 12 using handle 18 until opening 20 is below housing 14 and the force of gravity causes the contents of container 12 to fall out opening 20 thereby emptying container 12 of its contents. Bail 16 is retained between extension 60 and area 62 and is prevented from rotating to a position in front of opening 20.

Various changes may be made to the embodiments shown and described herein without departing from the scope of the present invention which is to be interpreted in accordance with the following claims.

What is claimed is:

1. A refuse container, comprising:

(a) a housing having an opening for receiving refuse;

(b) a bail pivotally attached to the housing for pivotal movement between a first position in front of the opening and a second position adjacent the housing;

(c) a handle attached to the housing positioned adjacent to the bail when the bail is in the second position;

(d) an attachment member comprising a clip dimensioned to securely and releasably hold the bail within the clip, the attachment member oriented with respect to the housing to releasably attach the bail to the attachment member when the bail is in the second position, the attachment member positioned on the housing adjacent the handle to permit attachment of the bail to the attachment member when the bail is in the second position.

2. The refuse container of claim 1 wherein the attachment member is positioned with respect to the handle to enable a thumb of a user to restrain the bail in or near the second position while simultaneously gripping the handle.

3. The refuse container of claim 1 wherein the attachment member is positioned with respect to the handle to enable a thumb of the user to direct the bail into the attachment member when the bail is in the second position while simultaneously gripping the handle.

4. The refuse container of claim 1 wherein the clip comprises a finger element which is dimensioned with respect to the housing to retain the bail between the element and the housing by means of friction between the element, the housing and the bail.

5. The refuse container of claim 1 wherein the clip comprises a finger element dimensioned and shaped with respect to the housing to retain the bail between the element and the housing by means of a snap fit of the bail with respect to the element and the housing.

6. The refuse container of claim 5 wherein the finger element is resiliently deformable.

7. The refuse container of claim 1 further comprising a bail rest adjacent the attachment member positioned to contact the bail when the bail is near the second position without the bail being releasably secured by the attachment member, the bail rest positioned with respect to the handle to enable the thumb of a user to restrain the bail against the rest while simultaneously gripping the handle.

8. The refuse container of claim 7 wherein the bail rest is integral with the attachment member.

9. The refuse container of claim 7 wherein the bail rest comprises a guide to guide the bail toward and into the attachment member.

10. The refuse container of claim 9 wherein the bail rest is integral with the attachment member.

11. The refuse container of claim 1 wherein the bail is pivotally attached to diametrically opposed points on the housing.

12. The refuse container of claim 11 wherein the bail extends across the opening when in the first position to enable lifting and transporting of the container by using the bail with the opening at the top of the housing.

13. The refuse container of claim 11 wherein the container comprises a support for supporting the container on its side on a support surface, the support located on a surface of the housing opposite to the handle and wherein the opening comprises a side contacting the support surface when the container is on its side with the support on the support surface.

14. The refuse container of claim 13 wherein the support is integral with the housing.

15. The refuse container of claim 13 wherein the support includes an extension extending laterally outwardly from the container.

16. The refuse container of claim 1 wherein the longitudinal axis of the handle is perpendicular to the longitudinal axis of the bail in every position of the bail between the first and second positions.

17. The refuse container of claim 1 wherein the handle is integral with the attachment member.

18. The refuse container of claim 1 wherein the bail comprises a resiliently deformable section aligned with the clip for releasable attachment of the bail and deformable section in the clip.

* * * * *